US010458165B1

(12) United States Patent
Tsai

(10) Patent No.: US 10,458,165 B1
(45) Date of Patent: Oct. 29, 2019

(54) ADJUSTABLE DOOR HINGE ASSEMBLY

(71) Applicant: Miao-Hsueh Tsai, Taichung (TW)

(72) Inventor: Miao-Hsueh Tsai, Taichung (TW)

( * ) Notice: Subject to any disclaimer, the term of this patent is extended or adjusted under 35 U.S.C. 154(b) by 0 days.

(21) Appl. No.: 16/195,924

(22) Filed: Nov. 20, 2018

(51) Int. Cl.
*E05D 11/06* (2006.01)
*E05D 7/04* (2006.01)
*E05D 7/00* (2006.01)

(52) U.S. Cl.
CPC ..... *E05D 7/04* (2013.01); *E05D 7/0027* (2013.01); *E05D 2007/0469* (2013.01); *E05Y 2600/12* (2013.01); *E05Y 2600/61* (2013.01); *E05Y 2600/622* (2013.01); *E05Y 2900/132* (2013.01)

(58) Field of Classification Search
CPC ..... E05D 7/04; E05D 7/0027; E05D 7/0045; E05D 7/0009; E05D 3/02; E05D 5/02; E05D 5/0215; E05D 5/0223; E05D 5/023; E05D 11/0054; E05D 2007/0469; E05Y 2600/10; E05Y 2600/12; E05Y 2600/502; E05Y 2900/132; E05Y 2900/148; E05Y 2600/61; E05Y 2600/622; Y10T 16/554; Y10T 16/534; Y10T 16/5358; Y10T 16/5321; Y10T 16/53225; Y10T 16/53253
See application file for complete search history.

(56) References Cited

U.S. PATENT DOCUMENTS 2,588,258 A * 3/1952 Lowman ..... E05D 7/0027 16/243
4,381,580 A * 5/1983 Hellstrom ..... E05D 7/0027 16/243
5,755,011 A * 5/1998 Green ..... E05D 7/0027 16/238
5,799,370 A * 9/1998 Davidian ..... E05D 7/0415 16/236
6,212,734 B1 * 4/2001 Commons ..... E05D 7/0027 16/243
6,516,494 B2 * 2/2003 Nakamoto ..... E05D 7/0027 16/236
7,331,085 B2 * 2/2008 Heid ..... E05D 7/04 16/242
7,334,293 B2 * 2/2008 Erickson ..... E05D 7/0423 16/243
7,587,788 B2 * 9/2009 Heid ..... E05D 7/04 16/242
8,490,246 B2 * 7/2013 Waddell ..... E05D 7/0423 16/238

(Continued)

*Primary Examiner* — Chuck Y Mah

(74) *Attorney, Agent, or Firm* — Alan D. Kamrath; Mayer & Williams PC

(57) ABSTRACT

A door hinge assembly includes a first part with a first knuckle, a second part with a second knuckle, and a pin. The pin pivotably extends through the first knuckle and fixedly extends through the second knuckle. A first adjustment member threadedly connected to the first inner threaded portion in the first knuckle to move the pin and the second part up and down. A sleeve is mounted to the second knuckle and has a slot in which the second leaf is inserted. The first part has an index area which is located corresponding to the lower end of the sleeve to indicate the axial distance that the door hinge assembly is made. A cover unit is connected to the second leaf. A second adjustment member threadedly extends through the second leaf and adjusts the door hinge assembly back and forth.

5 Claims, 6 Drawing Sheets

(56) References Cited

U.S. PATENT DOCUMENTS

| | | | | |
|---|---|---|---|---|
| 2008/0104798 | A1* | 5/2008 | Hoppe | E05D 7/0027 16/236 |
| 2008/0307606 | A1* | 12/2008 | Karlsson | E05D 7/0415 16/243 |
| 2011/0296652 | A1* | 12/2011 | Zhang | E05D 7/0027 16/239 |
| 2012/0102674 | A1* | 5/2012 | King | E05D 7/0027 16/237 |

* cited by examiner

ADJUSTABLE DOOR HINGE ASSEMBLY

BACKGROUND OF THE INVENTION

1. Fields of the Invention

The present invention relates to a door hinge assembly, and more particularly, to an adjustable door hinge assembly that is adjusted precisely in different directions.

2. Descriptions of Related Art

A conventional door hinge assembly generally includes two leaves which are pivotably connected to each other by a pin, and the two leaves are respectively fixed to a door and a frame so as to allow the door to open and close relative to the door hinge assembly. The door hinge assembly is required to be installed correctly so that the door can close and open as expected. Once the door hinge assembly is not installed properly, the two leaves of the hinge assembly are unscrewed off from the door and the frame, the holes are left in the door and frame and affect the second-time installation of the hinge assembly.

The present invention is intended to provide an adjustable door hinge assembly that is designed to eliminate the drawbacks mentioned above.

SUMMARY OF THE INVENTION

The present invention relates to a door hinge assembly and includes a first part and a second part, and a pin. The pin pivotably extends through the first knuckle, and fixedly extends through the second knuckle, The pin is pivotable relative to the first knuckle, and fixed to the second knuckle. A sleeve is mounted to the second knuckle and positioned between the top of the second knuckle and the top piece. The length of the sleeve is longer than the sum of the length of the second knuckle and the length of the index portion marked on the first part. When the first adjustment member that is threadedly connected to the first knuckle and contacts the lower end of the pin is rotated, the second part is moved relative to the first part to adjust axial distance of the door hinge assembly. The lower end of the sleeve is in flush with the index area to indicate the axial distance that the door hinge assembly is adjusted. When the second adjustment member that threadedly extends through the second leaf is rotated, the door hinge assembly is adjusted back and forth.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
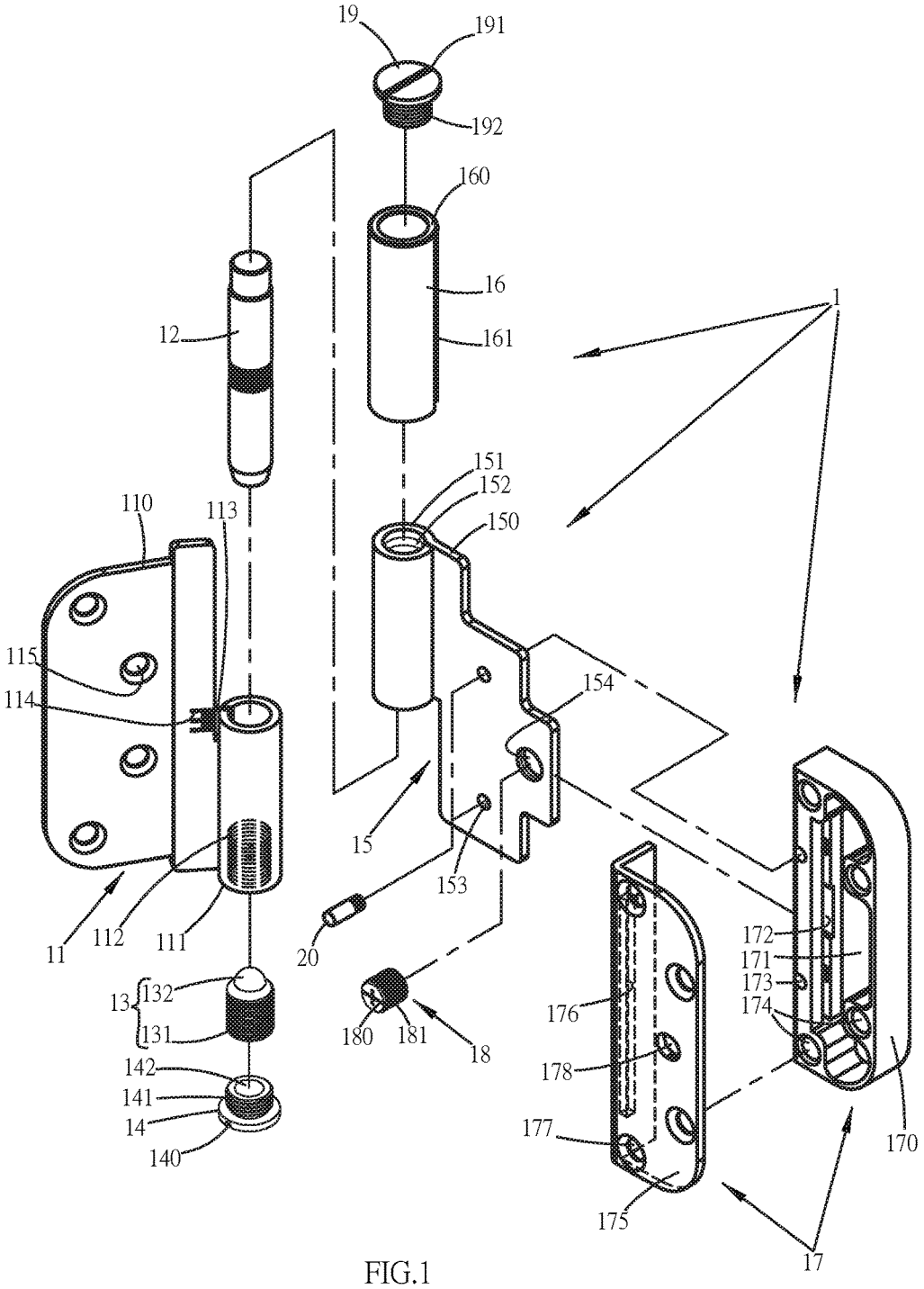
FIG. 1 is an exploded view of the door hinge assembly of the present invention.
Figure 2:
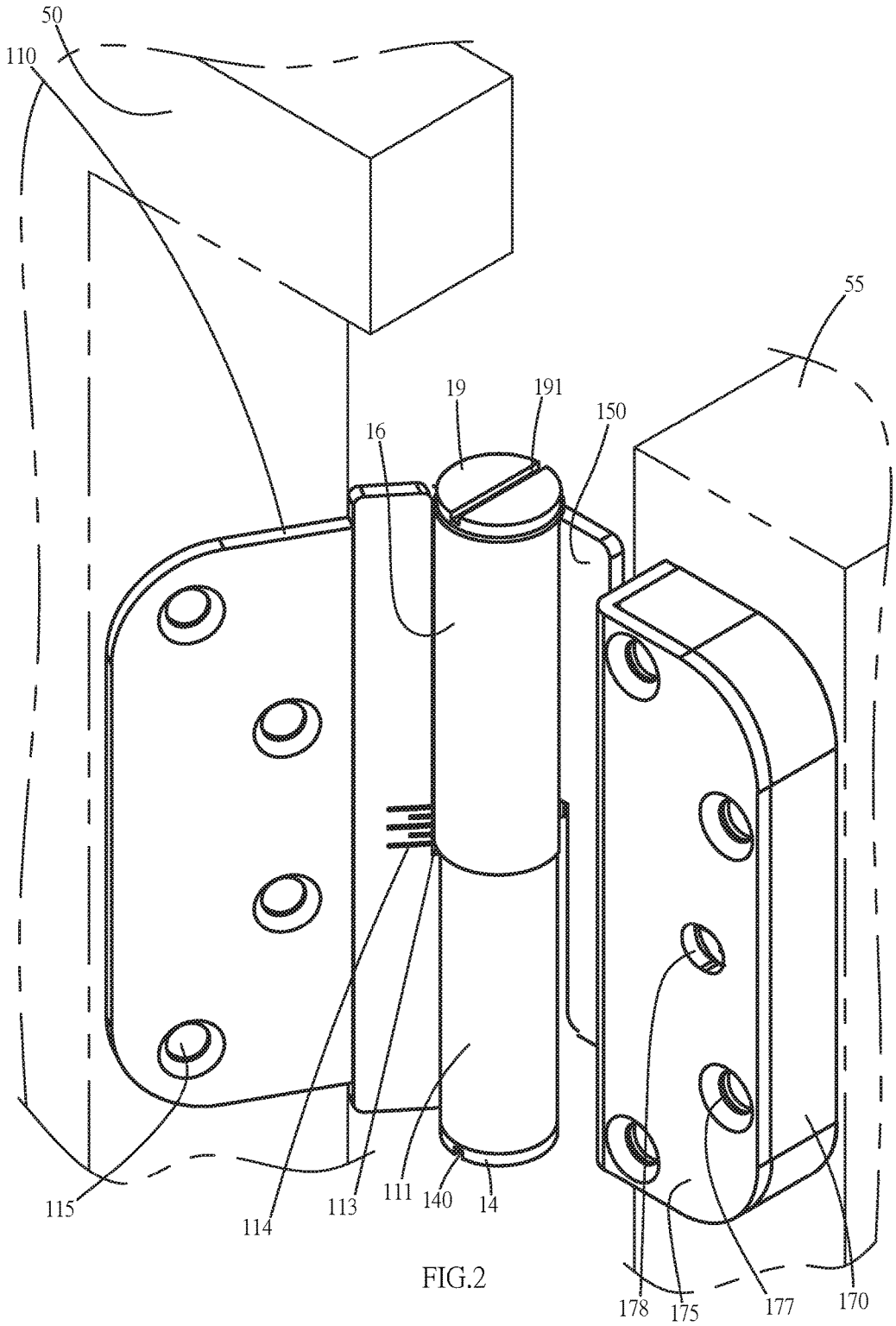
FIG. 2 shows that the first and second parts of the door hinge assembly of the present invention are respectively connected to a frame and a door.

Referring to FIGS. 1 to 7, the door hinge assembly 1 of the present invention comprises a first part 11 and a second part 15 which is pivotably connected to the first part 11 by a pin 12. The first part 11 includes a first leaf 110 and a first knuckle 111, and the first knuckle 111 is formed with the first leaf 110 and has a passage defined axially therethrough. A first inner threaded portion 112 is defined in the lower section of the passage of the first knuckle 111. A slit 113 is defined between the first knuckle 111 and the first leaf 110. An index area 114 is formed on the first leaf 110 and located corresponding to the slit 113. The first leaf 110 has multiple holes 115 defined therethrough. The first leaf 110 is fixed to a frame 50 by extending bolts (not shown) through the holes 115 and connected to the frame 50 as shown in FIG. 2.

The second part 15 includes a second leaf 150 and a second knuckle 151. The second knuckle 151 is formed with the second leaf 150 and has a passage defined axially therethrough. A second inner threaded portion 152 is defined in an upper section of the passage of the second knuckle 151. The second leaf 150 has multiple apertures 153 and a threaded hole 154 respectively defined therethrough. The pin 12 pivotably extends through the first knuckle 111 so that the first leaf 110 is pivotable relative to the pin 12. The pin 12 fixedly extends through the second knuckle 151 so that the pin 12 is integral with the second knuckle 151 of the second part 15.

A first adjustment member 13 includes a first threaded section 131 and a driving portion 130, wherein the first threaded section 131 is threadedly connected to the first inner threaded portion 112 in the first knuckle 111. The driving portion 130 is defined in the lower end of the first adjustment member 13 so as to be driven by a tool. A head 132 protruded from the top of the first adjustment member 13 and the head 132 is a semi-ball shaped head which is engaged with a recess 120 defined in the lower end of the pin 12. The recess 120 is located in the first knuckle 111.

A bottom piece 14 includes a second threaded section 141 and a driving flange 140, wherein the second threaded section 141 is threadedly connected to the first inner threaded portion 112 in the first knuckle 111 to prevent the first adjustment member 13 from dropping from the first knuckle 111. The driving flange 140 of the bottom piece 14 is shaped to be driven by a tool. A through hole 142 is defined axially through the bottom piece 14 to allow a tool to extend through the through hole 142 to reach the driving portion 130 of the first adjustment member 13.

A sleeve 16 includes a top end 160, and a slot 161 is defined axially through the wall of the sleeve 16. The slot 161 of the sleeve 16 is ended at a distance below the top end 160 of the sleeve 16. The length of the sleeve 16 is longer than the sum of the length of the second knuckle 151 and the length of the index portion 114. Specifically, the length of the slot 161 is longer than the sum of the length of the second knuckle 151 and the length of the index portion 114.

A cover unit 17 includes a base 170 and a cover 175 which is connected to the base 170. The base 170 has a room 171 defined therein, and a chamber 172 is defined in the base 170. The chamber 172 communicates with the room 171.

Multiple first holes 173 and multiple second holes 174 are respectively defined in the base 170. Multiple rods 20 extend the apertures 153 of the second leaf 150 and are connected to the first holes 173. The cover 175 includes an elongate hole 176 which is located corresponding to the chamber 172, so that the second leaf 150 is inserted into the elongate hole 176 and is received in the chamber 172. Multiple positioning holes 177 are defined through the cover 175 and located corresponding to the second holes 174. An adjustment hole 178 is defined through the cover 175 and located corresponding to the room 171. Multiple bolts extend through the positioning holes 177 of the cover 175 and are connected to the second holes 174.

A second adjustment member 18 includes outer threads 181 defined in the outer surface thereof, and a driving portion 180 is formed in one end of the second adjustment member 18. The second adjustment member 18 threadedly extends through the threaded hole 154 of the second leaf 150 and contacts the inner bottom of the room 171 of the base 170. A tool (not shown) may extend through the adjustment hole 178 and is engaged with the driving portion 180 to rotate the second adjustment member 18.

A top piece 19 includes outer threads 192 defined in the outer surface thereof. A driving portion 191 is formed in one end of the top piece 19 so as to be driven by a tool. The outer threads 192 of the top piece 19 is threadedly connected to the second inner threaded portion 152 of the second knuckle 151 to position the sleeve 16 between the top of the second knuckle 151 and the top piece 19, such that the sleeve 16 does not shift or drop off due to impact. The lower end of the sleeve 16 is inserted into the slit 113 of the first part 11 and located corresponding to the index area 114. Besides, the second knuckle 151 is completely received in the sleeve 16.

Figure 4:
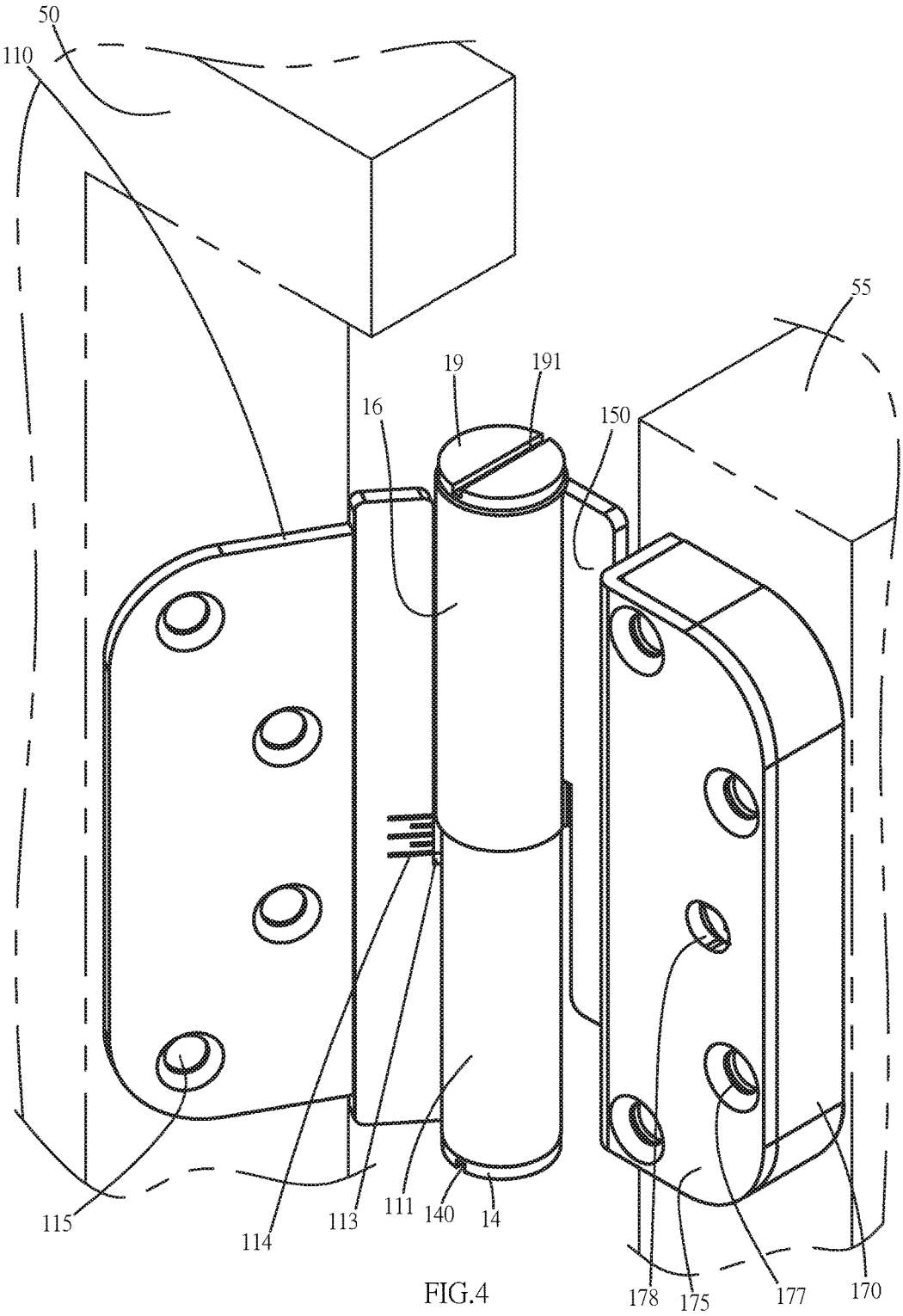
FIG. 4 shows that the second part is adjusted upward.
Figure 5:
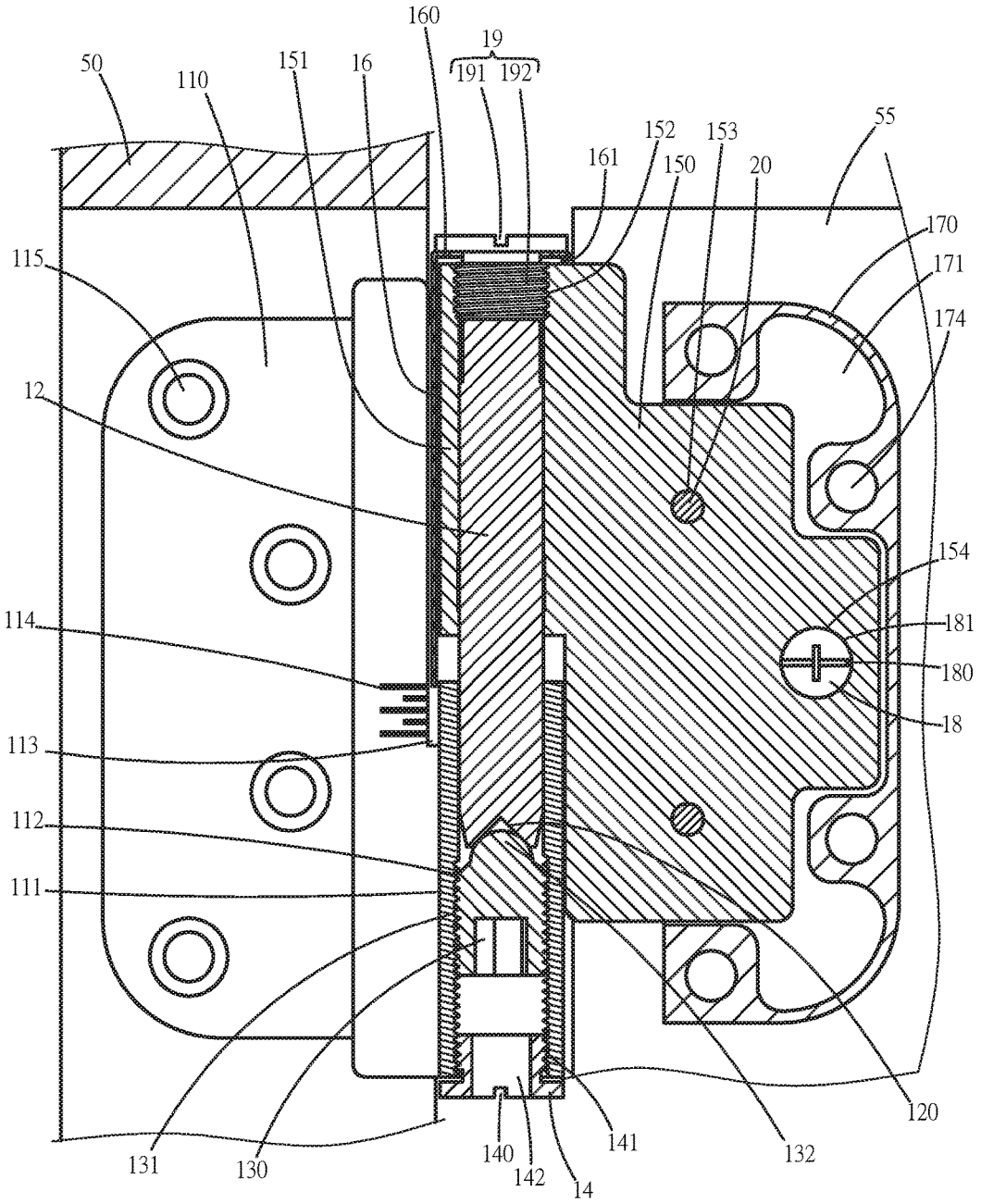
FIG. 5 is a partial cross sectional view to show the adjustment in FIG. 4 of the door hinge assembly of the present invention.

When installing, the first leaf 110 is fixed to the frame 50 by extending bolts (not shown) through the holes 115 in the first leaf 110. The second leaf 150 is inserted through the elongate hole 176 of the cover 175 and is inserted into the chamber 172 of the base 170. The rods 20 extend through the apertures 153 and are inserted into the first holes 173, so that the second leaf 150 is not separated from the base 170. The second adjustment member 18 is then inserted into the adjustment hole 178 and threadedly extends through the threaded hole 154 of the second leaf 150 to allow the contact portion 182 of the second adjustment member 18 to contact the inner bottom of the room 171. The cover 175 is then slid to align the positioning holes 177 of the cover 175 with the second holes 174 of the base 170. Bolts extend through the positioning holes 177 of the cover 175 and the second holes 174 of the base 170, and are connected to the door 55 as shown in FIGS. 2 and 4.

Figure 6:
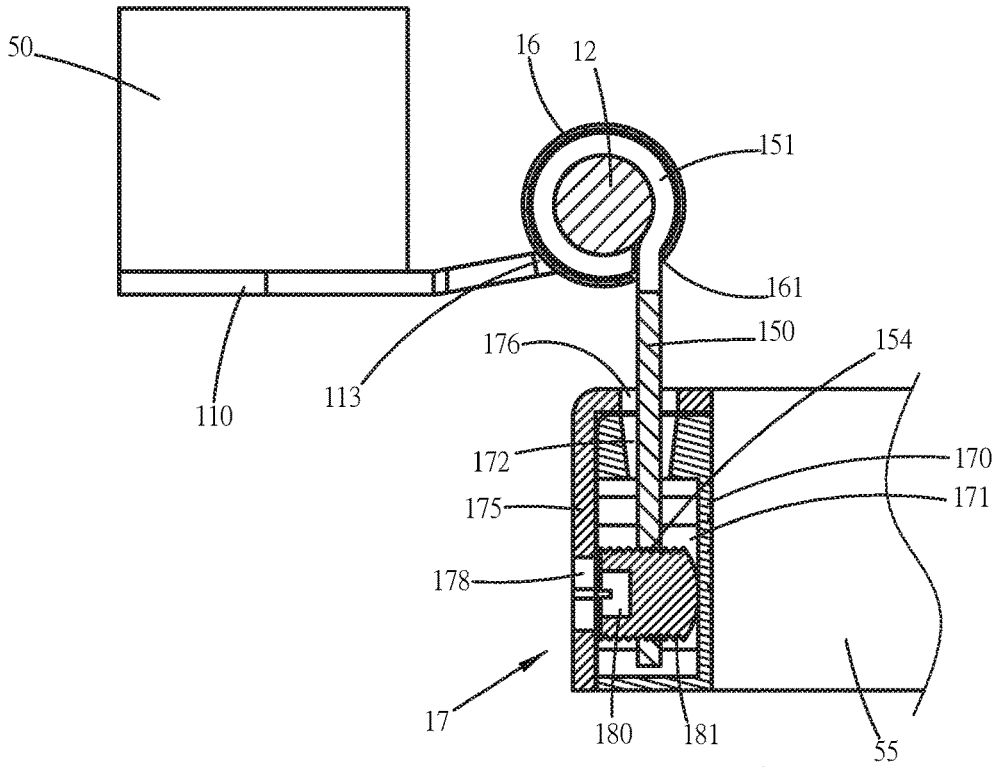
FIG. 6 is an end cross sectional view of the adjustment in FIG. 4 of the door hinge assembly of the present invention.
Figure 7:
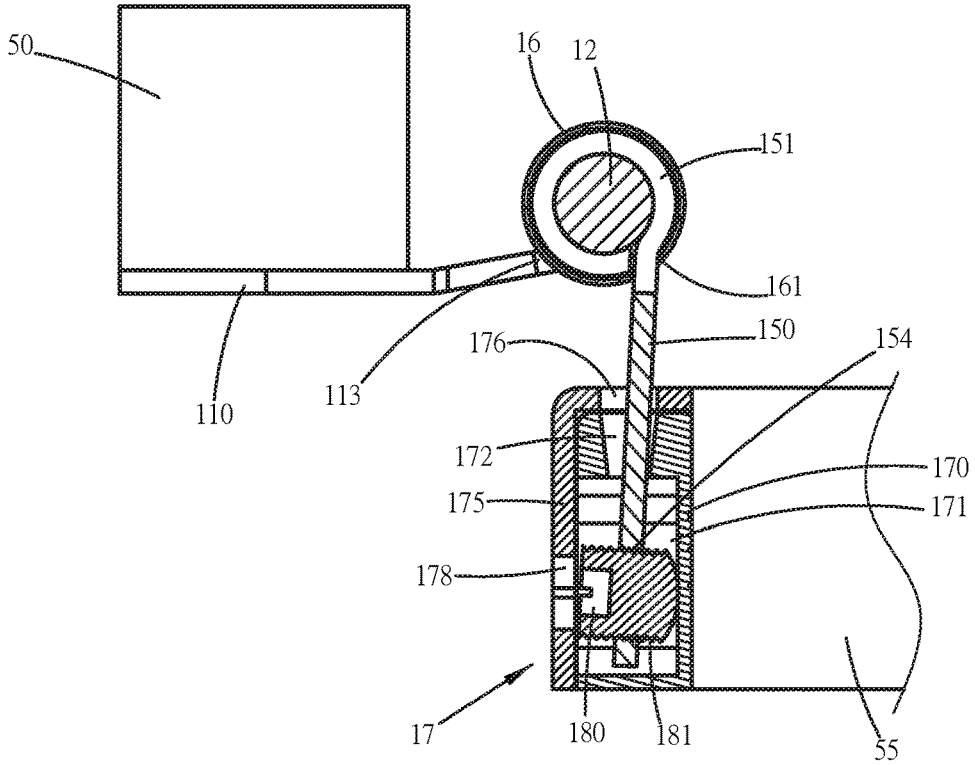
FIG. 7 shows that the door hinge assembly of the present invention is adjusted back and forth.

As shown in FIG. 6, if the distance between the frame 50 and the door 55 needs to be reduced, the user uses a tool to extend through the adjustment hole 178 of the cover 175 and directly rotates the driving portion 180 of the second adjustment member 18, because the second adjustment member 18 is threadedly connected to the threaded hole 154 of the second leaf 150, so that the rotation of the second adjustment member 18 can move the second leaf 150 together with the door 55 toward the frame 50 as shown in FIG. 7. Similarly, when the distance between the frame 50 and the door 55 needs to be increased, the second adjustment member 18 should be rotated in opposite direction.

Figure 3:
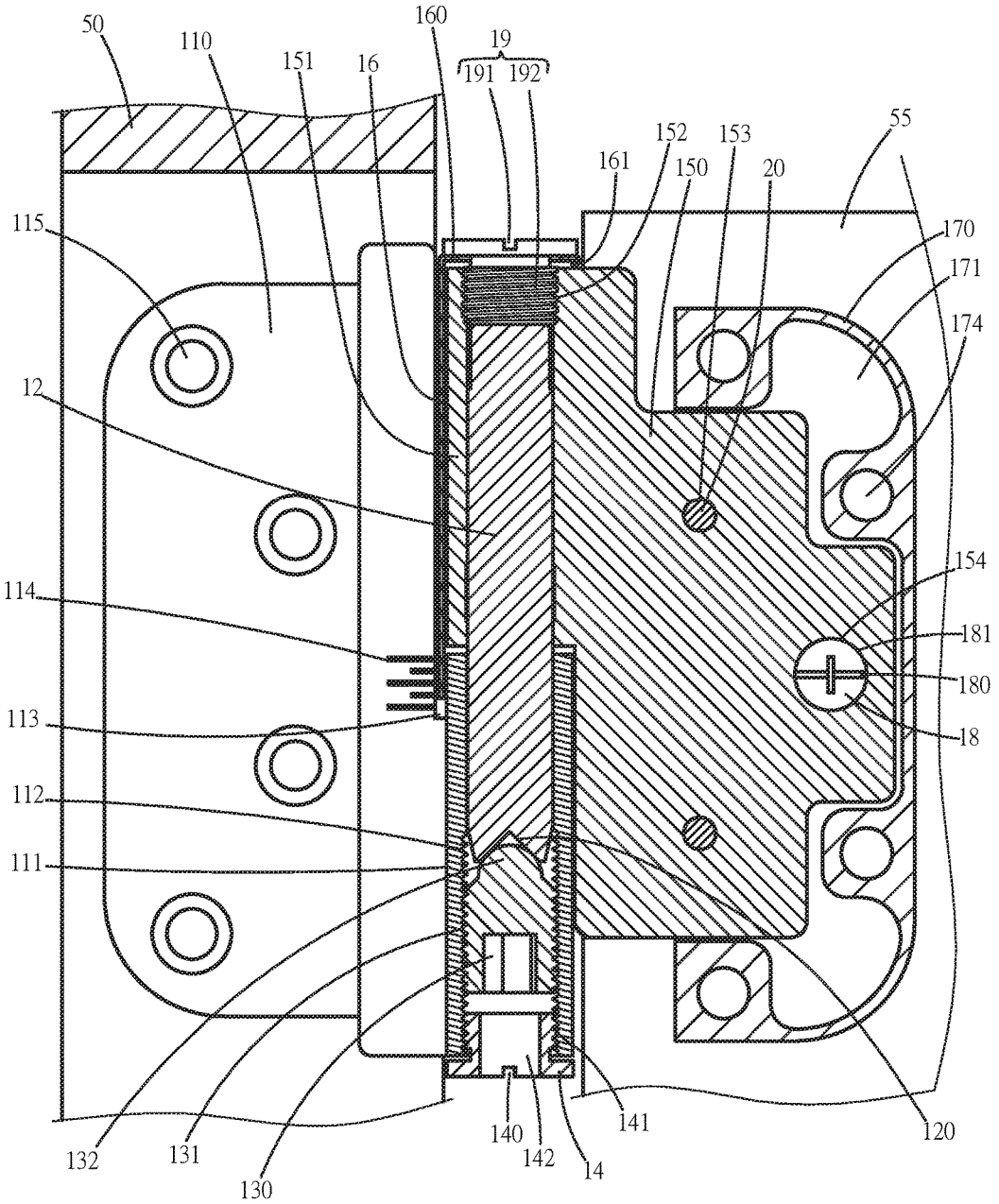
FIG. 3 is a partial cross sectional view to show the door hinge assembly of the present invention.

As shown in FIGS. 2 and 3, when the door 55 needs to be moved in in vertical direction relative to the frame 50, a tool is inserted into the through hole 142 and directly drives the first adjustment member 13. The first adjustment member 13 threadedly moves along the first inner threaded portion 112 of the first knuckle 111, and pushes the pin 12 upward. Specifically, the head 132 of the first adjustment member 13 is engaged with the recess 120 of the pin 12 and pushes the pin 12 upward. The upward movement of the pin 12 also moves the second part 15, the sleeve 16, the cover unit 17 and the door 55 upward because the pin 12 is integrally with the second part 15. The distance between the lower end of the second knuckle 151 and the top of the first knuckle 111 is increased, so that the distance between the top edge of the door 55 and the frame 50 is reduced. The pin 2 extends from the top of the first knuckle 111. Because the sleeve 16 is mounted to the second knuckle 151, and the length of the slot 161 is longer than the sum of the length of the second knuckle 151 and the length of the index portion 114, so that the adjustment gap between the first and second knuckles 111, 151 is covered by the sleeve 16. Besides, a mark or a positioning of the index area 114 that is located corresponding to the lower end of the sleeve 16 indicates the axial distance that is adjusted. If the distance between the top edge of the door 55 and the frame 50 needs to be increased, the first adjustment member 13 is rotated in opposite direction.

While we have shown and described the embodiment in accordance with the present invention, it should be clear to those skilled in the art that further embodiments may be made without departing from the scope of the present invention.

What is claimed is:

1. A door hinge assembly 1 comprising:

a first part having a first leaf and a first knuckle, the first knuckle formed with the first leaf and having a passage defined axially therethrough, a first inner threaded portion defined in the passage of the first knuckle, a slit defined between the first knuckle and the first leaf, an index area formed on the first leaf and located corresponding to the slit, the first leaf having multiple holes defined therethrough;

a second part having a second leaf and a second knuckle, the second knuckle formed with the second leaf and having a passage defined axially therethrough, a second inner threaded portion defined in the passage of the second knuckle, the second leaf having multiple apertures and a threaded hole respectively defined therethrough;

a pin pivotably extending through the first knuckle and fixedly extending through the second knuckle, the pin being pivotable relative to the first knuckle, and fixed to the second knuckle;

a first adjustment member having a first threaded section and a driving portion, the first threaded section threadedly connected to the first inner threaded portion in the first knuckle, the driving portion defined in a lower end of the first adjustment member and adapted to be driven by a tool, a head protruded from a top of the first adjustment member and in contact with a lower end of the pin;

a bottom piece having a second threaded section and a driving flange, the second threaded section threadedly connected to the first inner threaded portion in the first knuckle to prevent the first adjustment member from dropping from the first knuckle, the driving flange of the bottom piece adapted to be driven by a tool, a through hole defined axially through the bottom piece and adapted to accept a tool to extend through the through hole to reach the driving portion of the first adjustment member;

a sleeve including a top end, a slot defined axially through a wall of the sleeve, a length of the sleeve being longer than a sum of a length of the second knuckle and a length of the index portion;

a cover unit having a base and a cover which is connected to the base, the base having a room defined therein, a chamber defined in the base and the second leaf inserted into the base and received in the chamber, the chamber communicating with the room, multiple first holes and multiple second holes respectively defined in the base, multiple rods extending the apertures of the second leaf and connected to the first holes, the cover including an elongate hole located corresponding to the chamber, multiple positioning holes defined through the cover located corresponding to the second holes, and an adjustment hole defined through the cover located corresponding to the room, multiple bolts extending through the positioning holes of the cover and connected to the second holes;

a second adjustment member having outer threads defined in an outer surface thereof, a driving portion formed in one end of the second adjustment member and adapted to be driven by a tool, the second adjustment member threadedly extending through the threaded hole of the second leaf and contacts an inner bottom of the room of the base;

a top piece having outer threads defined in an outer surface thereof, a driving portion formed in one end of the top piece and adapted to be driven by a tool, the outer threads of the top piece threadedly connected to the second inner threaded portion of the second knuckle to position the sleeve between a top of the second knuckle and the top piece, a lower end of the sleeve inserted into the slit of the first part and located corresponding to the index area, when the first adjustment member is rotated, the second part is moved relative to the first part to adjust axial distance of the door hinge assembly, a gap between a lower end of the second knuckle and a top of the first knuckle is covered by the sleeve, when the second adjustment member is rotated, the second leaf is moved to adjust the door hinge assembly back and forth.

2. The door hinge assembly as claimed in claim 1, wherein a positioning of the index area that is located corresponding to the lower end of the sleeve indicates the axial distance that is adjusted.

3. The door hinge assembly as claimed in claim 1, wherein the pin includes a recess defined in the lower end thereof which is located in the first knuckle, the head of the first adjustment member is engaged with the recess of the pin.

4. The door hinge assembly as claimed in claim 1, wherein the slot of the sleeve is ended at a distance below the top end of the sleeve, a length of the slot is longer than the sum of the length of the second knuckle and the length of the index portion.

5. The door hinge assembly as claimed in claim 1, wherein the adjustment hole is located corresponding to the second adjustment member and adapted to receive a tool to reach the second adjustment member.

* * * * *